US005722820A

United States Patent [19]

Wild et al.

[11] Patent Number: 5,722,820

[45] Date of Patent: Mar. 3, 1998

[54] PROGRESSING CAVITY PUMP HAVING LESS COMPRESSIVE FIT NEAR THE DISCHARGE

[75] Inventors: Alan G. Wild, Woodstock; Kamran Z. Mirza, Springfield, both of Ohio

[73] Assignee: Robbins & Myers, Inc., Dayton, Ohio

[21] Appl. No.: 654,359

[22] Filed: May 28, 1996

[51] Int. Cl.[6] ..... F04C 2/107; F04C 5/00

[52] U.S. Cl. ..... 418/48; 418/153; 418/178

[58] Field of Search ..... 418/48, 153, 178

[56] References Cited

U.S. PATENT DOCUMENTS

| | | | |
|---|---|---|---|
| 3,139,035 | 6/1964 | O'Connor | 418/48 |
| 3,435,772 | 4/1969 | Schlecht | 418/48 |
| 3,443,482 | 5/1969 | Lummus et al. | 418/48 |
| 4,187,061 | 2/1980 | Jürgens | 418/48 |
| 4,415,316 | 11/1983 | Jürgens | 418/48 |
| 5,120,204 | 6/1992 | Mathewson et al. | 418/178 |
| 5,358,390 | 10/1994 | Jager | 418/48 |

FOREIGN PATENT DOCUMENTS

| | | | |
|---|---|---|---|
| 1553197 | 8/1970 | Germany | 418/48 |
| 3304751 | 8/1984 | Germany | 418/48 |
| 4312123 | 10/1994 | Germany | 418/153 |

*Primary Examiner*—John J. Vrablik

*Attorney, Agent, or Firm*—Thompson Hine & Flory LLP

[57] ABSTRACT

A progressing cavity pump is provided in which the compressive fit between the rotor and stator is gradually reduced with the distance from the suction end of the pump. This gradual decrease in compressive fit allows for increased slippage near the discharge end of the pump, resulting in better distribution of the internal differential pressure along the length of the pump. The differential pressure distribution in turn reduces heat build-up near the discharge end, increasing the life of the elastomeric stator or rotor.

15 Claims, 3 Drawing Sheets

PROGRESSING CAVITY PUMP HAVING LESS COMPRESSIVE FIT NEAR THE DISCHARGE

BACKGROUND

The present invention relates to helical gear pumps, and more particularly, to helical gear pumps in which the internal pressure is evenly distributed throughout the length of the pump.

A typical helical gear pump, or progressing cavity pump, comprises an externally threaded rotor co-acting with an internally helical threaded stator, where the stator has one more leads or starts than the rotor. Pumps of this general type are typically built with a rigid metallic rotor and a stator which is formed from a flexible or resilient material such as rubber. The rotor is made to fit within the stator bore with an interference fit, i.e., there is a compressive fit between the rotor and stator. This compressive fit results in seal lines where the rotor and stator contact. These seal lines define or seal off definite cavities bounded by the rotor and stator surfaces. A complete set of seal lines define a stage of the pump, and the pressure capability of a pump of this type is a function of the number of stages.

In operation, the progressing cavity pump must work to overcome external conditions, such as pumping fluids through extensive lengths of piping, and therefore a differential pressure is created by the pump to counteract such external conditions. As the external pressure increases, the differential pressure must increase to overcome this pressure. In order to increase the pressure capability of a progressing cavity pump it is common practice to increase the number of pump stages by adding to the rotor and stator length.

Further, typical progressing cavity pumps can be used to pump a wide range of fluids including fluids which solids in suspension, high viscosity fluids, and shear sensitive fluids; and since pumps of this type are positive displacement pumps, they can pump fluids with entrained gasses without vapor locking. However, since progressing cavity pumps generally have lower internal leakage values than other types of rotary positive displacement pumps, they are limited in their ability to handle high gas to liquid ratios where high differential pressures are required, due to the temperature limitations of the elastomeric stator material.

It is also common knowledge that when a progressing cavity pump with multiple stages operates, the internal differential pressure is not evenly distributed across the entire rotor/stator length. Tests have shown that a disproportionate amount of the pressure is carried by the stages nearest the discharge end of the pump. This is because for pressure to be distributed in the pump, the pressure must be able to pass from one cavity to the next by leaking across the seal lines. This leakage across seal lines is also referred to as "slip". However, leakage can only occur when a certain minimum pressure is achieved to deflect the resilient rotor or stator member. Therefore, when the minimum pressure exists in one cavity to permit leakage across the seal lines forming that cavity, the pressure that leaks into the second cavity will probably not be enough to permit leakage into a third cavity, and so forth. This is why, at very low pressures, the entire differential pressure may be developed by the last stage only.

A significant problem with this disproportionate pressure distribution is that the excessive pressure in the discharge stages of the rotor/stator assembly causes excessive heat to build up in the discharge stages of the stator, which commonly results in premature pump failure. Further, this disproportionate pressure distribution in progressing cavity pumps is exacerbated in applications where there is a significant amount of gas in the fluid being pumped. Fluids which are a combination of gas and liquid are typically called two phase fluids; and when the liquid phase of the gas and liquid fluid is a combination of different liquids, such as oil and water, the fluids are typically called multi-phase fluids. Multi-phase fluids create special problems for progressing cavity pumps due to the compressibility of the gas phase of the fluid.

The volume of the multi-phase fluid which enters the rotor/stator progressing cavities is determined by the pressure at the inlet to the cavities. Therefore, due to the increasing internal pressures towards the discharge end, as the multi-phase fluid progresses through the length of the rotor/stator assembly, the gas will compress, reducing the total fluid volume. However, since the cavity volume remains constant, the disproportionate pressure distribution discussed above will be even more pronounced, resulting in exacerbated heat buildup in the latter stages of the pump. This occurs as a result of the Gas Laws which state that as the pressure increases the volume will decrease and the temperature will increase. Theoretically, if the volume of the gas is not allowed to decrease as it passes through the pump, and the pressure increases, the temperature will increase substantially. Tests have shown that this temperature increase does occur, but not to the extent indicated theoretically. The exacerbated heat buildup also occurs as a result of increased leakage across seal lines near the discharge end, which results in an increased flexing of the resilient rotor or stator member, which in turn adds to the heat build up in the rubber.

One known solution to this pressure distribution problem is to loosen the compressive fit between the rotor and stator evenly along the length of the rotor/stator assembly to increase the amount of internal leakage or slip from all of the cavities. This loosened fit promotes better pressure distribution throughout the length of the rotor/stator assembly; however, the loosened fit also reduces the total pressure capability of the pump, and can thus result in increased wear and reduced life of the rotor and stator.

Another recognized solution to the problem is to alter the geometry of the rotor and stator to provide a pump with cavities which become smaller with their distance from the suction end. One such invention is disclosed in U.S. Pat. No. 2,765,114 to Chang, which discloses a cone shaped rotor and a cone shaped stator used to form a compressor. However, the tooling required to construct such a compressor is expensive, and the axial alignment of the rotor and stator in this type of design is difficult.

Accordingly, a need exists for a progressing cavity pump which is able to pump two phase and multi-phase fluids, and especially where the gasses of the fluids comprise 50% or more of the total fluid volume at standard conditions, and which is not susceptible to excessive heat build-up at the discharge end due to insufficient internal pressure distributions.

DEFINITIONS

The term "compressive fit" refers to the fit between the resilient rotor or stator member and the rigid rotor or stator member. One of the rotor and stator elements is formed (in whole or in part) from resilient, elastomeric material, and the other one of the rotor and stator elements is formed (in whole or in part) from rigid, preferably metallic material.

Furthermore, the rotor will have a transverse, cross-sectional diameter which is slightly larger than a transverse, cross-sectional diameter of a semi-circular end portions of the internal bore formed by the stator. Therefore, when the rotor is placed within the stator bore, the portions of the resilient member which are in contact with the rigid member will be compressed by the rigid member.

The term "compression" refers to the amount that the resilient member must deflect such that the rotor can fit within the stator bore.

SUMMARY OF THE INVENTION

The present invention provides a progressing cavity pump in which the compressive fit between the rotor and stator is gradually reduced with the distance from the suction end of the pump. This decrease in compression allows an increase in slip to occur from the cavities near the discharge end of the rotor/stator assembly, resulting in better distribution of the internal differential pressure throughout the length of the rotor/stator assembly. In accordance with the invention there is a tighter fit between the rotor and stator near the suction end, and as a result of this, the total differential pressure capability of the pump is not significantly affected.

The rate or manner in which the compressive fit is decreased near the discharge end is dependent upon the number of stages, the size of the pump, the differential pressure, and the gas to liquid ratio at standard conditions.

Preferably, this gradual decrease in compression fit is achieved by applying a wear resistant coating to the metallic rotor which is thicker at the suction end of the rotor and becomes gradually thinner with the distance from the suction end of the rotor. This variation in fit may also be achieved by machining the rotor with a slight taper such that the transverse cross sectional diameter of the rotor gradually decreases with the distance from the suction end, or by molding the stator with a slight taper such that the transverse cross sectional diameters of the semi-circular ends of the internal bore formed by the stator gradually increases with the distance from the suction end. Furthermore, the variation in fit may be achieved by performing a combination of any or all of the above means.

Accordingly, it is an object of the present invention to provide a progressing cavity pump in which the internal pressure is more evenly distributed across the entire length of the rotor/stator assembly; thus resulting in an enhanced ability to pump two phase and multi-phase fluids in which gasses comprise 50% or more of the total fluid volume at standard conditions.

DETAILED DESCRIPTION

Figure 1:
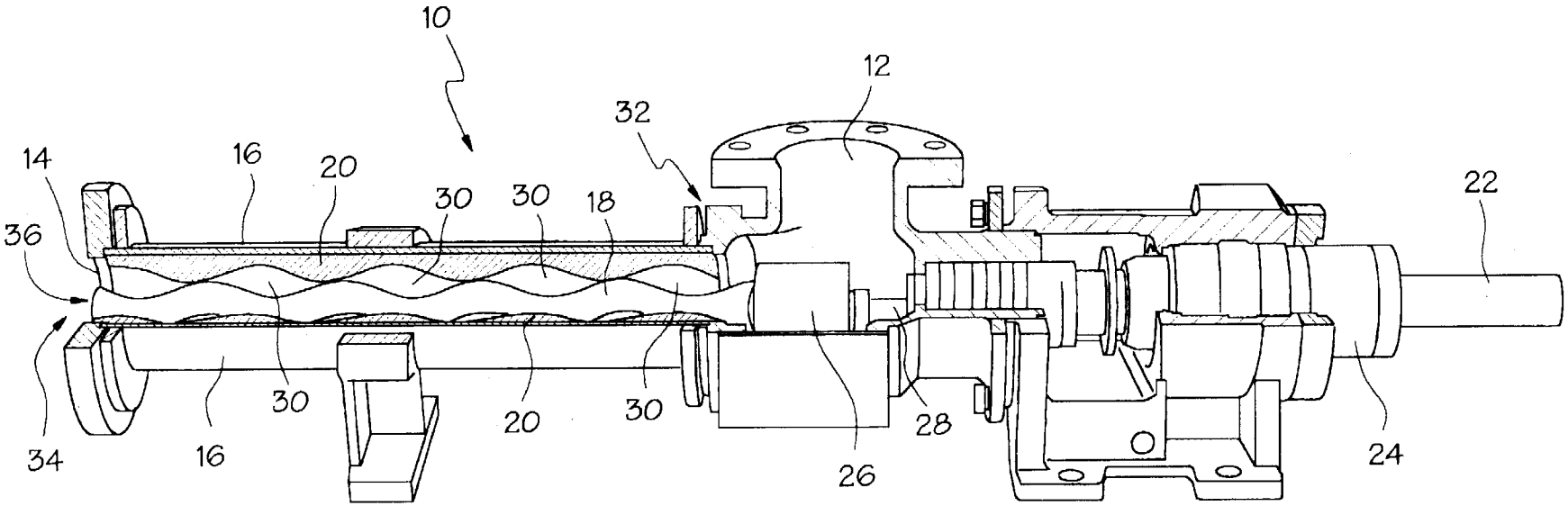
FIG. 1 is a prospective, broken away in part, view of a progressing cavity pump for use with the present invention.

As shown in FIG. 1, a typical progressing cavity pump 10 includes a suction chamber 12 and a discharge port 14. The pump has a stator tube 16, a single lead helical screw or rotor 18, and a double lead helical nut, or stator 20 having an internal bore 36 extending longitudinally therethrough. Because the stator is in the form of a double lead helical nut, the bore is in the form of a double lead helical gear. The stator 20, fixed within the stator tube 16, is preferably formed from resilient and flexible elastomeric material, and the rotor 18 is preferably metallic and rotates eccentrically inside the stator bore 36. The rotor 18 is driven by a drive shaft 22 which is coupled to the rotor by a pair of gear joints 24, 26 and a connecting rod 28 as is commonly known in the art. For additional information on the operation and construction of progressing cavity pumps, reference can be made to U.S. Pat. No. 2,512,764 and in U.S. Pat. No. 2,612,845.

Figure 2:
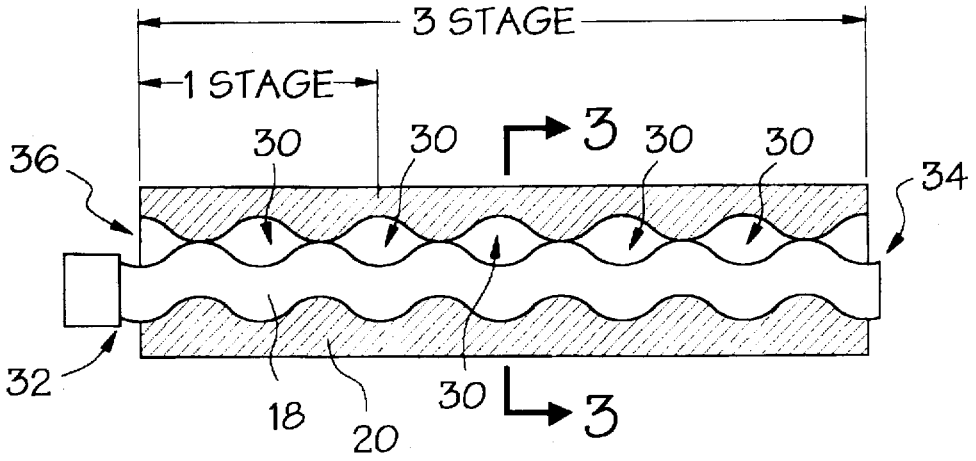
FIG. 2 is a longitudinal cross-sectional view of the rotor and stator elements (the rotor/stator assembly)

As shown in FIG. 2, as the rotor 18 turns inside the stator bore 36, cavities 30 are formed between the rotor 18 and the stator 20 which progress from the suction end 32 of the rotor/stator assembly to the discharge end 34 of the rotor/stator assembly. In one revolution of the rotor two separate sets of cavities are formed, one set of cavities opening at exactly the same rate as the second set of cavities is closing. This results in a predictable, pulsationless flow. The pitch length of the stator 20 is twice that of the rotor 18, and in the present embodiment, the rotor/stator assembly combination is identified as 1:2 profile elements, which stands for the one lead on the rotor and the two leads on the stator. As one of ordinary skill in the art will recognize, the present invention can also be for use with more complex progressing cavity pumps such as 9:10 designs where the rotor has nine leads and the stator has ten leads (as is commonly known in the art, any combination is possible so long as the stator has one additional lead than the rotor).

The compressive fit between the rotor 18 and elastomeric stator 20 results in a series of seal lines where the rotor contacts the stator. The seal lines assure separation of the individual cavities progressing through the pump with each revolution of the rotor. The set of seal lines formed in one stator pitch length constitutes one stage.

The differential pressure capability of the progressing cavity pump is determined by the number of stages a pump has. Thus, a two stage pump has twice the pressure capability of a single stage pump, a three stage pump has three times the pressure capability of a single stage pump, etc.

Figure 3:
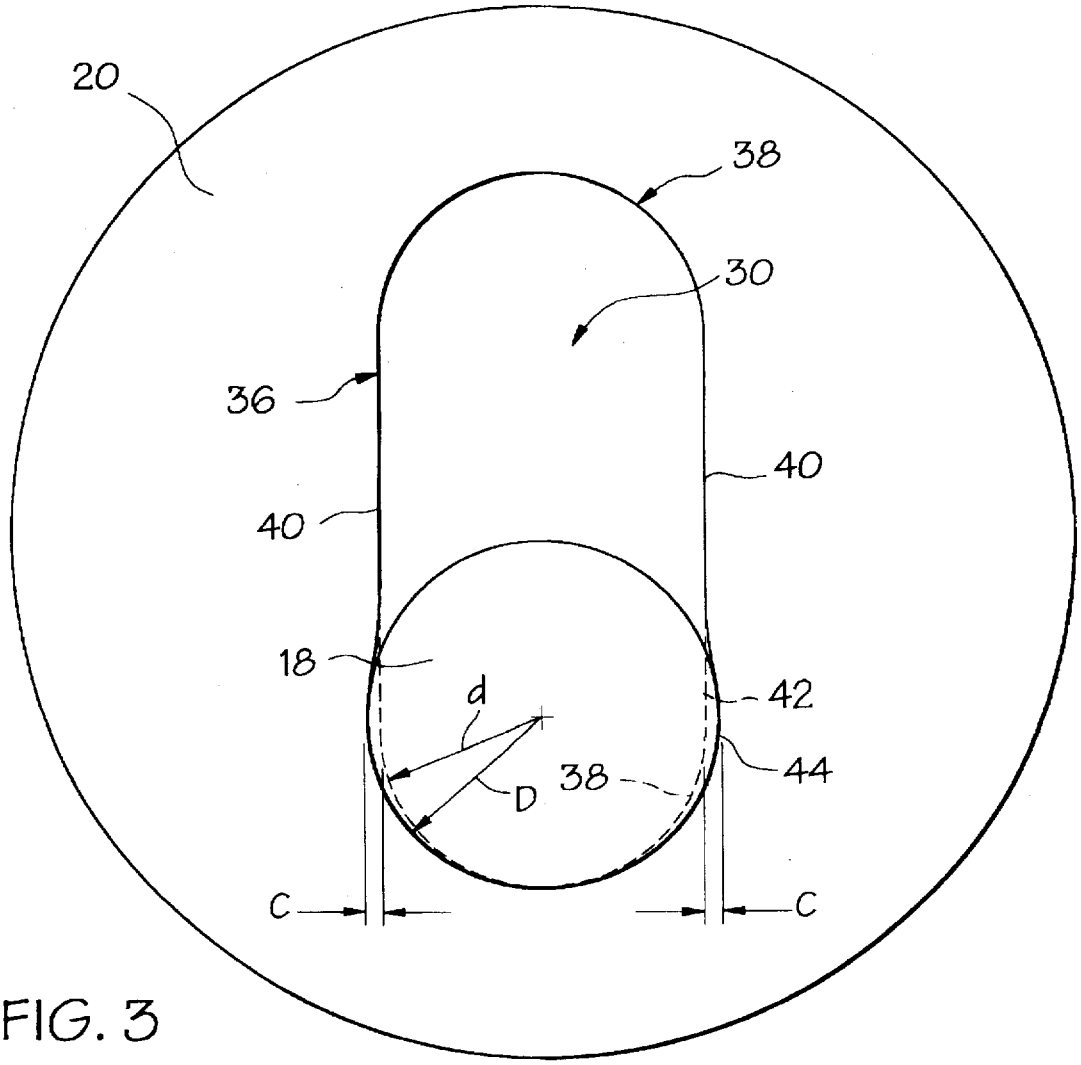
FIG. 3 is a transverse cross-sectional view of the rotor and stator elements taken along lines 3—3 of FIG. 2, showing a compressive fit between the rotor and stator.

As shown in FIGS. 3, the transverse cross-sectional outline of the stator's internal bore 36 has an outline defined by a pair of spaced semi-circular concave ends 38 and a pair of tangents 40 joining the semi-circular ends. The diameters d of the semicircular ends 38 are slightly less than the diameter D of the transverse cross-section of the rotor 18, thus forming a compressive interference fit between the stator 20 and the rotor 18. The transverse cross-sectional outline of the stator's internal bore 36 without a rotor inserted therewithin is shown in dashed lines and designated as 42, while the transverse cross-sectional outline of the stator's internal bore 36 expanded to receive the rotor therewithin is designated as 44. Of course, because the bore 36 must expand to receive the rotor 18, the stator 20 must correspondingly compress. Thus, the amount of compression in the stator 20 caused by the compressive fit between the rotor and stator is indicated by c.

If the rotor 18 were formed from resilient material and the stator 20 formed from rigid material, the rotor would experience the compression c.

Figure 4:
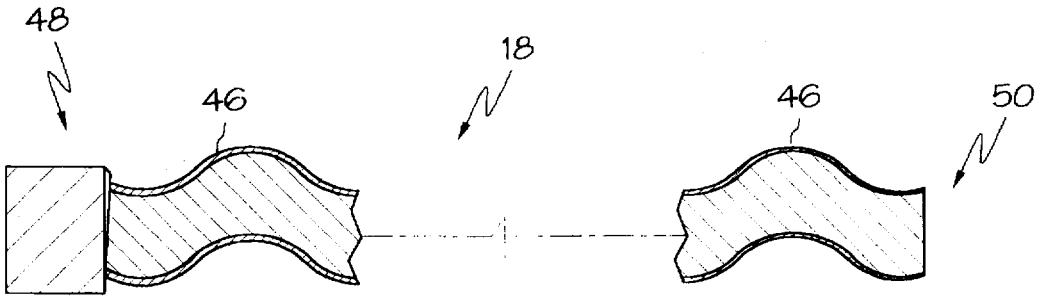
FIG. 4 is a longitudinal, cross-sectional view of the rotor according to an embodiment of the present invention.

Preferably the compression c between the rotor and stator is gradually reduced with the distance from the suction end 36 of the rotor/stator assembly. As shown in FIG. 4, this gradual decrease in compression is preferably achieved by applying a wear resistant coating 46 to the metallic rotor 18 which is thicker at the suction end 48 of the rotor and gradually thins with the distance from the suction end of the rotor (towards the discharge end of the rotor). This variation in coating thickness can be achieved by applying the coating at progressively decreasing thickness, or by applying the coating at a uniform thickness and buffing the rotor 18 such that the coating's thickness decreases with the distance from the suction end 48 of the rotor. Such wear resistant coatings are commonly known in the art, thus the compositions, properties or application procedures need not be described in further detail.

It should be apparent to one of ordinary skill in the art that while it is preferred that the compression c decreases linearly with the distance from the discharge end of the pump, it is within the scope of the invention that the compression be decreased exponentially with the distance from the discharge end of the pump, or decreased in a step-wise manner with the distance from the discharge end of the pump.

The amount of decrease in compression c from the suction end 36 to the discharge end 34 is dependent upon the number of stages, the pump size, the differential pressure, and gas to liquid ratio at standard conditions; and further, it is within the scope of the invention to provide any sufficient amount of reduction in compression from the suction end 36 to the discharge end 34 to achieve an improved differential pressure distribution from the discharge end of the rotor/stator assembly. Nevertheless, a reduction in the compression c from the suction end of the rotor/stator assembly to the discharge end of the rotor/stator assembly ranging from approximately five percent to approximately seventy-five percent is preferred to improve the performance and life of the pump, especially when pumping high gas to liquid ratio two-phase or multi-phase fluids. The particular percentage in compression reduction chosen from the above range will likewise depend upon the number of stages, the pump size, the differential pressure, and gas to liquid ratio at standard conditions. For example, the higher the gas ratio of the fluid being pumped, the higher the percentage in compression reduction will usually be required.

The gradual reduction in compression c from the suction end of the rotor/stator assembly to the discharge end of the rotor/stator assembly helps to alleviate the disproportionate pressure distribution along the length of the pump. As the compression c between the rotor 18 and stator 20 decreases, the susceptibility of that portion of the rotor and stator to slippage increases. Therefore, in the cavities 30 near the discharge end 34 of the pump, an increase in slippage will be encountered which helps to distribute the differential pressure along the entire length of the rotor/stator assembly. This increased pressure distribution will in turn decrease the temperature at the discharge end of the pump as can be recognized with reference to the universal gas law:

$$(P_s \times V)/T_s = (P_d \times V)/T_d$$

where V the volume of the cavity 30 (which is constant), $P_s$ is the differential pressure at the suction end, $T_s$ is the temperature of the fluid being transported at the suction end, $P_d$ is the differential pressure at the discharge end, and $T_d$ is the temperature of the fluid being transported at the discharge end. As can be seen from the above equation, as pressure $P_d$ increases in the discharge end, the temperature $T_d$ at the discharge end must also increase. Therefore, a decrease in differential pressure $P_d$ at the discharge end will accordingly decrease the temperature $T_d$ at the discharge end. Furthermore, the progressive decrease in compression c from the suction end to the discharge end of the pump still allows a sufficient amount of compression to remain, especially near the suction end, such that the overall differential pressure of the pump is not significantly affected.

Figure 5:
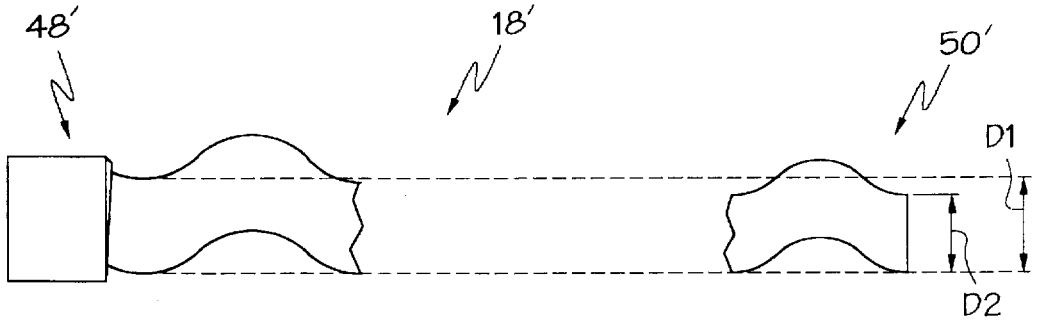
FIG. 5 is a longitudinal view of the rotor according to another embodiment of the present invention.
Figure 6:
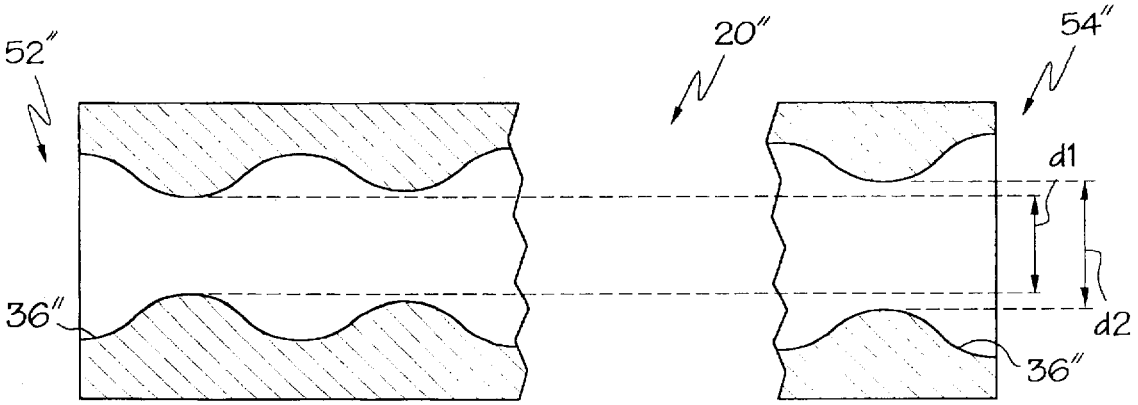
FIG. 6 is a longitudinal, cross-sectional view of the stator according to another embodiment of the present invention.

As shown in FIG. 5 the above variation in compressive fit may also be achieved by machining the rotor 18' with a slight taper such that the transverse cross sectional diameter D of the rotor gradually decreases with the distance from the suction end 48' of the rotor. To illustrate, the cross-sectional diameter of the rotor near the suction end 48' is labeled as D1 and the smaller cross-sectional diameter of the rotor near the discharge end 50' is labeled as D2. Additionally, as shown in FIG. 6, the variation in compressive fit may also be achieved by molding the stator 20" with a slight taper such that the transverse cross sectional diameter d of a semicircular ends of the internal bore 36" formed by the stator gradually increases with the distance from the suction end 52" of the stator. To illustrate, the transverse cross-sectional diameter of the semicicular ends of the internal bore 36" near the suction end 52" is labeled as d1 and the larger transverse cross-sectional diameter of the semicircular ends of the internal bore 36" near the discharge end 54" is labeled as d2. Furthermore, the variation in compressive fit may be achieved by performing a combination of any or all of the means described herein.

It should also be apparent to one of ordinary skill in the art that the present invention can also extend to progressing cavity pumps having a rigid or metallic stator and a resilient or elastomeric rotor. With pumps of this construction, the variation in fit can be achieved by applying a wear resistant coating to the rigid stator which is thicker at the suction end and thins with the distance from the suction end of the stator; by molding the resilient rotor with a slight taper such that the transverse cross sectional diameter of the rotor decreases with the distance from the suction end; by machining the rigid stator with a slight taper such that the transverse cross sectional diameter of the semicircular ends of the stator's internal bore increases with the distance from the suction end; or by a performing a combination of any or all of these.

Having described the invention in detail and by reference to the drawings, it will be apparent that modification and variations are possible without the departing from the scope of the invention as defined in the following claims.

What is claimed is:

1. A progressing cavity pump having a suction end and a discharge end, comprising:

a metallic rotor in the form of a helical gear with at least one lead; and a resilient stator having an internal bore in the form of a helical gear including one more lead than said rotor;

said rotor being rotationally disposed in said internal bore to form a plurality of cavities between said rotor and stator;

said rotor and said stator having a compressive fit between said rotor and stator; and said compressive fit near said discharge end being less than said compressive fit near said suction end;

whereby, internal pressure leakage from said cavities located near said discharge end is greater than internal pressure leakage from said cavities located near said suction end.

2. The progressing cavity pump of claim 1, wherein said compressive fit gradually decreases with the distance from said suction end.

3. The progressing cavity pump of claim 1, wherein said compressive fit causes said stator to compress, and the compression of said stator at said discharge end is approximately five to seventy-five percent of the compression of said stator at said suction end.

4. The progressing cavity pump of claim 1, wherein said compressive fit is decreased gradually with the distance from the suction end such that internal pressure of the pump remains substantially uniform with the distance from the suction end.

5. A progressing cavity pump having a suction end and a discharge end, comprising:

a rotor in the form of a helical gear with at least one lead; and a stator having an internal bore in the form of helical gear including one more lead than said rotor;

one of said rotor and stator being formed from resilient material while the other of said rotor and stator being formed from rigid material;

said rotor being rotationally disposed in said internal bore to form a plurality of cavities between said rotor and stator;

said rotor and said stator having a compressive fit wherein said resilient rotor or stator must compress to fit within or to receive said rigid stator or rotor respectively; and said compressive fit near said discharge end being less than said compressive fit near said suction end;

whereby, internal pressure leakage from said cavities located near said discharge end is greater than internal pressure leakage from said cavities located near said suction end.

6. The progressing cavity pump of claim 5, wherein said compressive fit gradually decreases with the distance from said suction end.

7. The progressing cavity pump of claim 5, wherein said compressive fit causes said resilient stator or rotor to compress, and the compression of said stator or rotor at said discharge end is approximately five to seventy-five percent of the compression of said stator or rotor at said suction end.

8. A progressing cavity pump having a suction end and a discharge end, comprising:

a metallic rotor in the form of a helical gear with at least one lead; and a resilient stator having an internal bore in the form of a helical gear including one more lead than said rotor;

said rotor being rotationally disposed in said internal bore to form a plurality of cavities between said rotor and said stator;

said rotor and stator having a compressive fit between said rotor and stator; and said rotor having a transverse cross-sectional diameter, said transverse cross-sectional diameter of said rotor at said discharge end being smaller than said transverse cross-sectional diameter of said rotor at said suction end, such that said compressive fit near said discharge end is less than said compressive fit near said suction end;

whereby, internal pressure leakage from said cavities located near said discharge end is greater than internal pressure leakage from said cavities located near said suction end.

9. The progressing cavity pump of claim 8, wherein said transverse cross-sectional diameter of said rotor gradually decreases with the distance from said suction end, such that said compressive fit gradually decreases with the distance from said suction end.

10. A progressing cavity pump having a suction end and a discharge end, comprising:

a metallic rotor in the form of a helical gear with at least one lead; and a resilient stator having an internal bore in the form of a helical gear including one more lead than said rotor;

said rotor being rotationally disposed in said internal bore to form a plurality of cavities between said rotor and said stator;

said rotor and stator having a compressive fit between said rotor and stator; and said rotor being coated with a protective coating, said coating being thicker at said suction end than at said discharge end, such that said compressive fit near said discharge end is less than said compressive fit near said suction end;

whereby, internal pressure leakage from said cavities located near said discharge end is greater than internal pressure leakage from said cavities located near said suction end.

11. The progressing cavity pump of claim 10, wherein said coating gradually thins with the distance from said suction end, such that said compressive fit gradually decreases with the distance from said suction end.

12. A progressing cavity pump having a suction end and a discharge end, comprising:

a metallic rotor in the form of a helical gear with at least one lead; and a resilient stator having an internal bore in the form of a helical gear including one more lead than said rotor, said internal bore having a transverse cross-sectional outline defined by a pair of spaced semi-circular concave ends joined by a pair of tangents, said semi-circular ends having a diameter;

said rotor being rotationally disposed in said internal bore to form a plurality of cavities between said rotor and said stator;

said rotor and stator having a compressive fit between said rotor and stator; and said diameter of said semi-circular ends of said internal bore near said discharge end being larger than said diameter of said semi-circular ends of said internal bore near said suction end, such that said compressive fit near said discharge end is less than said compressive fit near said suction end;

whereby, internal pressure leakage from said cavities located near said discharge end is greater than internal pressure leakage from said cavities located near said suction end.

13. The progressing cavity pump of claim 12, wherein said diameter of said semi-circular ends of said internal bore gradually increases with the distance from the suction end, such that said compressive fit gradually decreases with the distance from said suction end.

14. A progressing cavity pump having a suction end and a discharge end, comprising:

a rotor in the form of a helical gear with at least one lead; and a stator having an internal bore in the form of a helical gear including one more lead than said rotor;

one of said rotor and stator being formed from resilient material while the other of said rotor and stator being formed from rigid material;

said rotor being rotationally disposed in said internal bore to form a plurality of cavities between said rotor and stator;

said rotor and said stator having a compressive fit wherein said resilient rotor or stator must compress to fit within or to receive said rigid stator or rotor respectively; and said rigid rotor or stator being coated with a protective coating, said coating being thicker near said suction end than near said discharge end, such that said compressive fit near said discharge end is less than said compressive fit near said suction end;

whereby, internal pressure leakage from said cavities located near said discharge end is greater than internal pressure leakage from said cavities located near said suction end.

15. The progressing cavity pump of claim 14, wherein said coating gradually thins with the distance from said suction end.

* * * * *